US006095050A

United States Patent [19]

Figov

[11] Patent Number: 6,095,050

[45] **Date of Patent: *Aug. 1, 2000**

[54] PRINTING METHOD AND APPARATUS FOR PERFORMING THE SAME

[75] Inventor: Murray Figov, Ra'anana, Israel

[73] Assignee: Aprion Digital Ltd., Herzlia, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,602

[22] Filed: Feb. 20, 1998

[30] Foreign Application Priority Data

Feb. 23, 1997 [IL] Israel ..... 120295

[51] Int. Cl.[7] ..... B41M 7/00; B41J 2/01

[52] U.S. Cl. ..... 101/483; 347/101; 347/102; 347/100

[58] Field of Search ..... 101/416.1, 419, 101/420, 424.1, 483; 400/120.18; 156/284, 385, 386, 387, 388; 427/411; 428/195, 211; 347/101, 102, 100

[56] References Cited

U.S. PATENT DOCUMENTS

| | | | |
|---|---|---|---|
| 4,844,954 | 7/1989 | Taylor et al. | 427/407 |
| 4,859,521 | 8/1989 | Pike et al. | 428/195 |
| 4,952,426 | 8/1990 | Guttag | 427/258 |
| 5,270,368 | 12/1993 | Lent et al. | 524/236 |
| 5,385,092 | 1/1995 | Lewis et al. | 101/467 |
| 5,484,502 | 1/1996 | Bozanic | 156/238 |
| 5,513,567 | 5/1996 | Froh et al. | 101/170 |
| 5,537,486 | 7/1996 | Stratigos et al. | 382/137 |
| 5,662,976 | 9/1997 | Popat et al. | 428/40.1 |
| 5,761,363 | 6/1998 | Mills | 385/114 |
| 5,769,458 | 6/1998 | Carides et al. | 283/102 |

FOREIGN PATENT DOCUMENTS 0 407 054 A1 1/1991 European Pat. Off. .

OTHER PUBLICATIONS

Webster's Ninth New Collegiate Dictionary, p. 669, Mirriam Webster 1991 (4 pages).

WESSCO Varnishes—Technical Literature from Schmid Rhyner AG Print Finishing Dept., Zurich, Switzerland, Feb. 1996.

"Gloss and Environment"—Technical Literature from Schmid Rhyner AG Print Finishing Dept., Zurich, Switzerland.

*Primary Examiner*—John S. Hilten
*Assistant Examiner*—Daniel J. Colilla
*Attorney, Agent, or Firm*—Darby & Darby

[57] ABSTRACT

A printing method is provided that includes providing a substrate, such as paper or the like, and placing an image over the substrate, by ink jet printing. The resultant inked image is then fixed, such that it can not be smeared, smudged or distorted on the substrate, by placing a coating over at least the image. This method is also designed for use with offset printing equipment, and thus, eliminates problems associated with drying and set-off of the ink jet ink, permitting such a machine to include an ink jet head, and to be run to produce impressions at normal offset press speeds.

19 Claims, 3 Drawing Sheets

PRINTING METHOD AND APPARATUS FOR PERFORMING THE SAME

FIELD OF THE INVENTION

The present invention relates to ink jet printing, and more particularly to a printing method and apparatus that prints and fixes images with respect to the substrate, avoiding problems of smearing and distortion associated with incompletely dried ink.

BACKGROUND OF THE INVENTION

Ink jet printing is a conventional process used to print an image, typically in the form of digital information from a computer or the like, onto a substrate, such as paper. Specifically, this process provides a non-impact means for generating images by computer control over the direction of small droplets or particles in rapid succession onto the substrate. A primary ink jet printing system is a continuous jet system, where ink is forced under pressure from a single or multiple nozzles. The ink tends to form a droplet stream of a size and frequency determined mainly by the surface tension of the ink liquid, the application pressure and the nozzle(s) size(s).

FIG. 1 shows an example of a contemporary ink jet system 10. Ink from an ink source 11 is moved by a pump 12 through a filter 13 to a piezoelectric crystal driver 14, along a common line 15. The line 15 terminates in a nozzle 16, such that the ink breaks into droplets upon being forced, by the piezoelectric crystal driver 14, through the nozzle 16. The droplets form a dot stream 17 that moves through a charged unit 18 and then through high voltage deflection plates 19, that charge and deflect the ink stream 17 into respective charged 17*a* dots and deflected dots 17*b*, in accordance with a digital signal corresponding to the image to be printed. Dots in the charged dot stream 17*a*, are charged to different amounts, corresponding to the desired deflection, that once past the mist guard 20, contact the substrate 21 (e.g., paper) in a manner so as to form characters thereon. The substrate 21 is in turn, mounted on a drum 22 or the like, that rotates in the direction of the arrow 23. Dots of the deflected stream 17*b* exit the system in the direction of arrow 24, through a gutter or the like, and the ink, from which these dots are formed, may be returned to the ink source 11 if desired.

This continuous ink jet printing apparatus, as well as other conventional ink jet systems, such as drop on demand systems, employ water based inks, such as Ink No. 1007 used in model No. 5240 Ink jet printer, from Scitex Digital Printing, Inc., Dayton, Ohio, USA, and inks for the Smartjet 4012 continuous ink jet printer, from Iris Graphics, Inc., Bedford, Mass., for continuous ink-jet printers, and inks, such as those used in cartridge model numbers HP51626A, HP51625A, HP51629A and HP51649A for the HP DESK JET® and DESKWRITER® printer series, from Hewlett-Packard Company, Palo Alto, Calif., and those inks in cartridge model numbers S020034 and S020036 for the Epson® STYLUS™ printer series Color Ink Printer, from Seiko Epson Corporation, Japan, for drop on demand ink jet systems. Specific viscosities usually depend on the particular ink jet technology employed. For example, viscosities ranging from 1 to 10 centipoise are common for continuous ink jet inks and viscosities up to 30 centipose are common for drop on demand ink jet inks.

In order to achieve these low viscosities, the inks often contain a water soluble dye and have low viscosity additives that function to enhance performance and stability. The water soluble ink with the dye is such that the dye is required to be soluble in the ink, such that the ink dries rapidly once it is on the substrate (paper). If drying is too slow, smearing typically occurs by a subsequently printed sheet landing on the previously printed but still drying sheet, or if the wet or dry finger of an operator contacts the printed portions. Additionally, even in documents, days, weeks months, or even years old, a wet finger or a dry finger with sufficient pressure may be sufficient to smear the print on the document. Thus, as a result of the ink failing to properly dry, this gives rise to anesthetic documents, that in most cases must be reprinted, if possible, wasting both labor and materials.

Several attempts have been made at solving these problems. One approach employs a long drying oven, while another approach uses a special paper pretreated with a composition for fixing the dye. These attempts have substantial drawbacks.

In particular, the drying oven is expensive as it involves costly equipment and occupies a large amount of floor space. The special paper is also expensive, for it is a treated paper.

Ink jet printing is a relatively new process when it is compared with one of the most popular printing processes which is offset lithography. A fundamental difference between the two processes is that offset lithography requires a pre-imaged plate as a master, from which multiple copies are made. Therefore, ink jet printing can easily produce variable information from print to print, whereas this is not possible with pre-imaged offset plates. However, the nature of offset printing permits the use of very high viscosity inks and provides means of avoiding set-off for both line-work and continuous tone color on a variety of papers, including hard surface high quality coated paper for best quality printing. Because such offset inks are oil based and often contain air oxidisable oils, they are resistant to rubbing, especially after a few hours. However, these inks have not been adapted for use in ink jet printing processes.

SUMMARY OF THE INVENTION

The present invention provides improvements in the ink jet printing art by providing apparatus and methods for printing, that fix the ink over the substrate, such that the ink is dry and substantially water insoluble, whereby it will not smear, smudge or distort post printing. The present invention can be used with a wide variety of substrates, thus eliminating the need for special substrates and a wide variety of conventional, commercially available ink jet printing inks (including those described above), thus eliminating the need for bulky oven drying, that is usually required for high speed ink jet inks. Moreover, the present invention can be practiced with low cost materials, and is thus economical.

The present invention provides a printing method that comprises providing a substrate, such as paper or the like, and placing an image over the substrate, by ink jet printing. The resultant inked image is then fixed, such that it can not be smeared, smudged or distorted on the substrate, by placing a coating over at least the image. The coating is preferably a lacquer, such as a ultraviolet light curable varnish, that requires an additional ultraviolet light cure once the image has been coated. This method is also designed for use with offset printing equipment, and thus, eliminates problems associated with drying and set-off of the ink jet ink, permitting such a machine to include an ink jet head, and to be run to produce impressions at normal offset press speeds.

The present invention also provides an apparatus having structure for retaining and transporting a substrate, such as paper or the like, a mechanism for placing an image on the substrate, such as an ink-jet head for creating an inked image, and a device for coating at least the image, to fix the image, such that it can not be smudged on the substrate. This apparatus may be used with a offset printing equipment, as discussed above.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE EMBODIMENT

Figure 1:
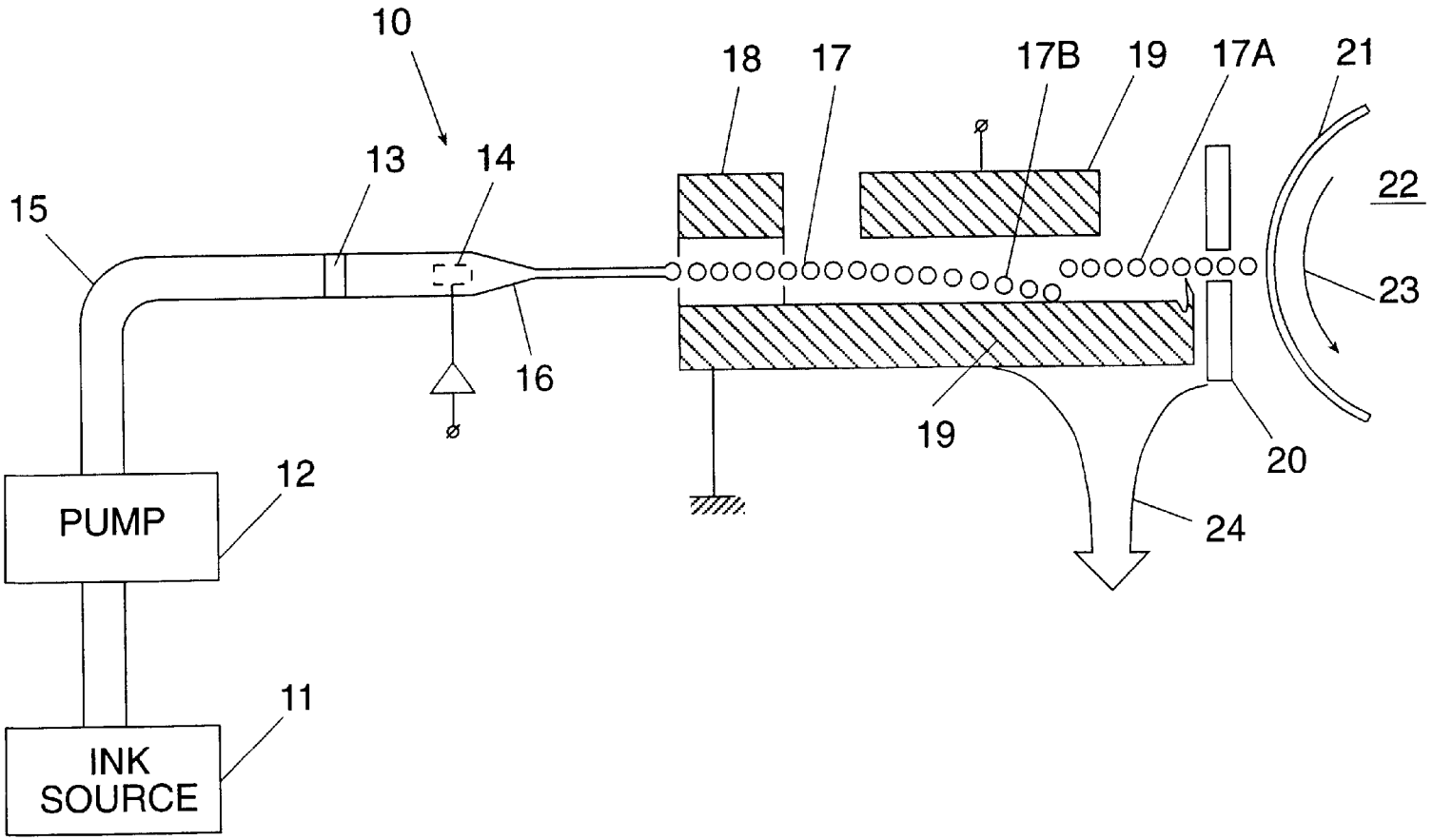
FIG. 1 PRIOR ART
FIG. 1 is a schematic drawing of an ink jet printing system of the prior art.
Figure 2:
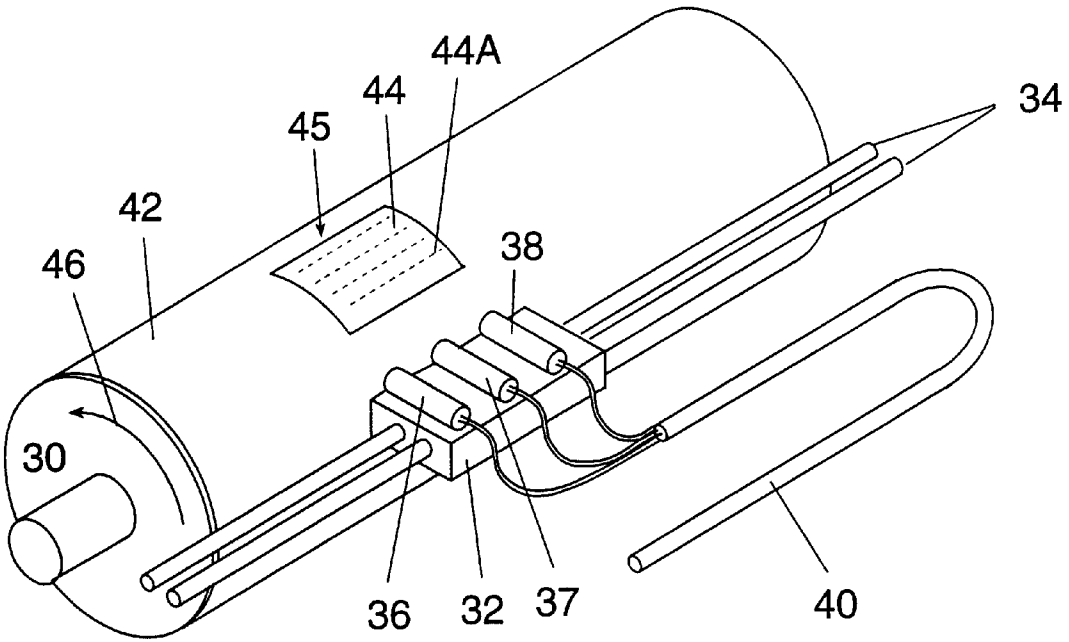
FIG. 2 is a perspective view of a portion of apparatus of the present invention with the substrate in a first position.

In FIG. 2, there is shown the present invention as incorporated in an offset printing apparatus, and in particular with an impression cylinder 30. A print head 32, mounted on guiderails 34 is positioned proximate to this impression cylinder 30. Ink jets 36, 37, 38, mounted on this print head 32, are in accordance with the ink jet system 10 described in FIG. 1 above. These ink jets 36, 37, 38 are supplied with ink, preferably conventional commercially available inks, such as those described above, through a tube 40 and controlled by a computer with a microprocessor (not shown) connected by electronics through this tube 40.

A substrate 42, such as paper, preferably a regular non-coated offset lithographic printing paper, or the like, is wrapped around the cylinder 30, having been fed onto the cylinder 30 by conventional feeding mechanisms associated with conventional offset lithography systems. The substrate 42 preferably has been previously imaged lithographically, as part of the offset lithography system (this lithographic image is not shown in order to better illustrate the present invention). The substrate 42, has an image 44 of printed matter 44*a*, within an image area 45, printed thereon by the respective ink jets 36, 37, 38 (as the cylinder 30 rotates in the direction of the arrow 46). The image area 45 is preferably an area of a standard shape, for example, a rectangle, square, triangle, trapezoid, polygon, circle, ellipse, or combinations thereof, corresponding to the peripheries of the image 44.

Figure 3:
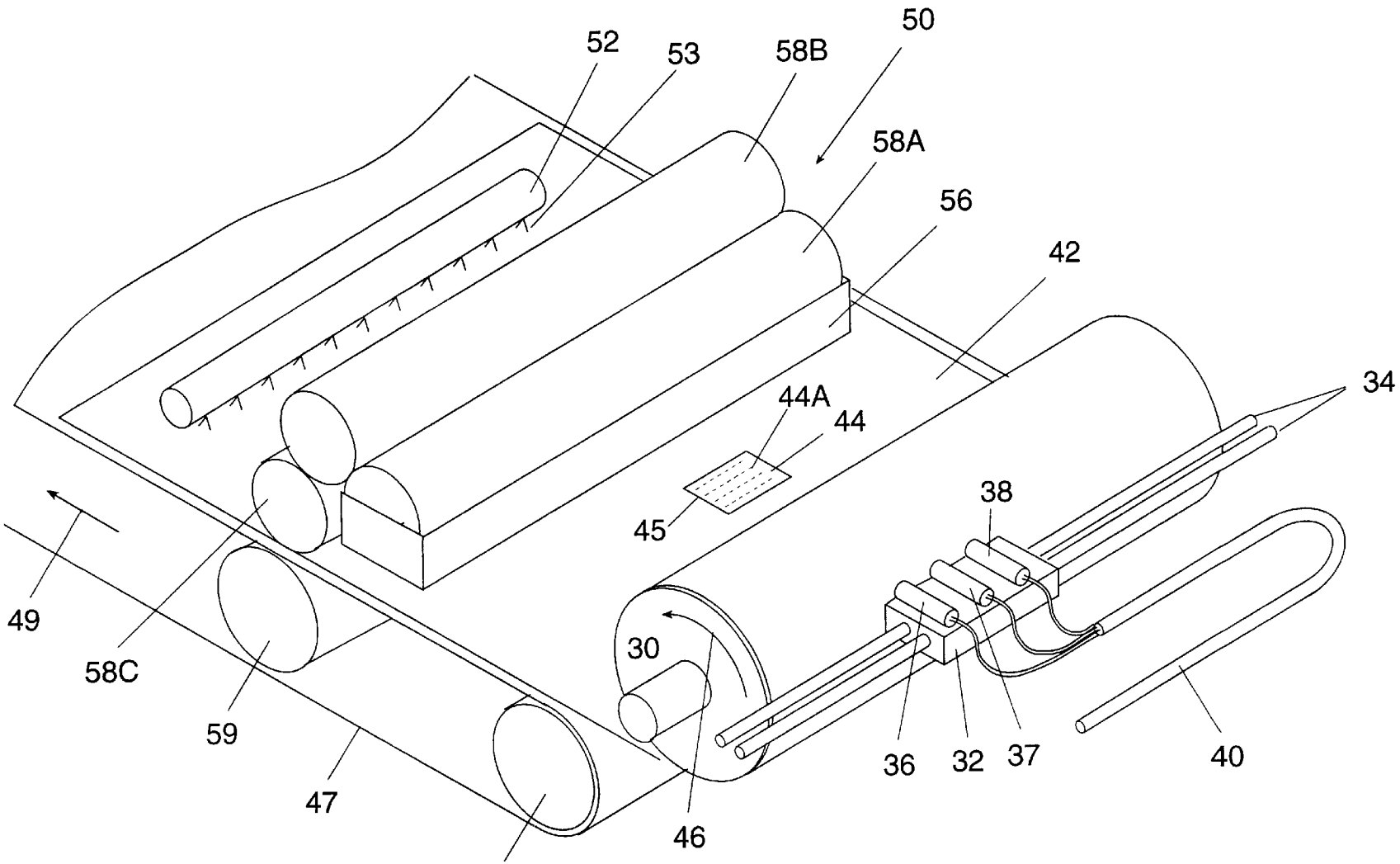
FIG. 3 is a perspective view of the apparatus of the present invention, with the substrate in a second position.

Turning now to FIG. 3, the substrate 42 has moved from the cylinder 30, onto a conveyer assembly 47, preferably driven by rolls 48 (only one shown) or the like, under computer control, that advances the substrate 42 forward (in the direction of the arrow 49), in coordination with the movement of the cylinder 30 (rotating in the direction of the arrow 46). The substrate 42 is then passed through a coating system 50, preferably computer-controlled, along the conveyer 47. The coating system 50 serves to place a coating (not shown), in single or multiple layers, preferably a single layer of lacquer or other similar material, over the image 44, and preferably in correspondence with the image area 45, to fix the image 44, specifically, the printed matter 44*a* thereof, onto the substrate 42. Alternately, the coating may be placed over the portions of the substrate larger (in area) than the image area 45, and overlapping it, or the coating may be placed over the entire substrate 42.

A lamp 52 is preferably along the conveyer assembly 47, at a point downstream from the coating system 50. The lamp 52 may be controlled by the above mentioned computer (not shown), preferably such that it is turned on prior to the printing process and is turned off once all substrates have been printed. The lamp 52 is preferably of an ultraviolet light, that emits radiation 53 for curing the lacquer coating placed onto the substrate 42. The resultant coated ink of the image 44 on the substrate 42 cannot be smeared or smudged and the now-coated ink becomes almost completely water insolvent.

The coating system 50 is such that lacquer is delivered from a trough 56 by rollers 58*a*, 58*b*, 58*c*, that deliver the lacquer, in the above described coatings to the substrate 42, in conjunction with an impression roller 59. Alternately, the lacquer could be sprayed on in accordance with any of the above patterns by a spraying mechanism, preferably under computer control. The preferred lacquer is an ultraviolet light curable varnish that does not attack the ink or cause bleeding in the dye of the ink (that is typically water based and the dye used therein is water soluble). Additionally, this lacquer coating preferably neither alters the substrate nor imparts a gloss to the substrate (e.g., paper). As a result, the substrate 42 maintains its original appearance, and thus, can be written on, such that the sheet of paper, printed in accordance with the present invention, and in particular, the lacquer coating, does not resist the added writing. One suitable lacquer is Photocure Varnish Number 7202, from Wessco Photo Curing, Schmid Rhymer AG, CH-8314, Switzerland.

In operation, a substrate 42, preferably an offset printed paper sheet or the like, is positioned on an impression cylinder 30, preferably automatically, as part of the offset printing apparatus, or mechanically. The substrate 42 is then moved proximate the print head 32, (as the impression cylinder 30 rotates in the direction of the arrow 46) where an image 44 is printed thereon. As the impression cylinder 30 continues to move, the substrate 42 is transferred to a conveyer 47, and moved (in the direction of the arrow 49) into proximity with the coating system 50, whereby a coating (not shown), preferably corresponding to the image area 45, is placed thereover. The coating, if an ultraviolet light curable varnish, is then moved under an activated lamp 52, that emits ultraviolet radiation 53, that cures the varnish. Movement of the impression cylinder 30, print head 32 and conveyer 47, and printing of the image 44, coating of the corresponding image area 45, and subsequent curing from the lamp 52 are coordinated by the computer (not shown), that controls the entire operation. The now printed substrate 42 is now processed in accordance with the present invention, and may be subjected to further processing if desired.

EXAMPLE 1

An ink-jet head, No. 5240, from Scitex Digital Printing, Dayton, Ohio, USA, in accordance with that shown in FIG. 1, was positioned over a variable sped Kirk Rudy conveyor, run at 2.9 meters per second. An image consisting of a centimeter square black area, vertical and horizontal bar codes and alphanumerics from six points to twenty-four points was jetted onto 100 gsm standard offset printing paper. The image was then immediately treated by applying a Wessco Photocure Varnish No. 7202 (described above) by means of a K Lox engraved roller (RK Print-Coat Instruments Ltd., Royston, Hertfordshire, UK) with a rubber roller. The image was not smudged in any way by the lacquer and was then ultra violet light cured for 30 seconds with a 400W Dymax 5000-EC source (Dymax Corporation, Torrington, Conn., USA) at a distance of approximately 10 cm.

After curing, the print was rubbed hard with a wet finger and the print did not smudge. Without lacquer treatment, the print could be easily smudged without rubbing by the application of drops of water.

While embodiments of the present invention have been described so as to enable one of skill in the art to practice the present invention, the preceding description is intended to be exemplary and should not be used to limit the scope of the invention, which should be determined by reference to the following claims.

What is claimed is:

1. A printing method comprising the steps of;

a. providing a substrate;

b. placing an image onto said substrate by applying at least one water based ink in a pattern corresponding to said image;

c. placing an organic based fluid coating over at least a portion of said inked image while said image is wet, said coating being such that said image is visible there through; and d. treating said coating to fix said inked image on said substrate.

2. The printing method of claim 1, additionally comprising curing said coating.

3. The method of claim 2, wherein said curing includes ultra violet light curing.

4. The method of claim 1, wherein said at least a portion of the image includes the entire image.

5. The method of claim 4, wherein said coating is insoluble with said at least one ink.

6. The method of claim 1, wherein said step of applying at least one ink employs ink jets.

7. The method of claim 1, wherein said substrate includes paper.

8. A printing method comprising the steps of:

a. providing a substrate:

b. applying at least one water based ink onto said substrate in a pattern corresponding to an image;

c. placing a coating layer over at least a portion of said image while said image is wet, said coating layer insoluble with said at least one ink, said coating layer being of an organic based fluid coating such that said image is visible therethrough; and d. curing said coating layer to bond said at least one ink onto said substrate.

9.The printing method of claim 8, wherein said step of applying at least one ink employs ink jets.

10. The method of claim 8, wherein said curing includes ultra violet light curing.

11. The method of claim 8, wherein said at least a portion of the image includes the entire image.

12. The method of claim 8, wherein said substrate includes paper.

13. A printing method comprising the steps of:

a. providing a substrate;

b. placing a pattern over said substrate by applying at least one water based ink to said substrate in accordance with said pattern; and c. fixing said pattern over said substrate by placing an organic based fluid coating over said pattern while said pattern is wet, said coating insoluble with said at least one ink, said coating being such that said pattern is visible therethrough, and curing said coating.

14. The method of claim 13, wherein said at least a portion of the image includes the entire image.

15. The method of claim 13, wherein said printed portions include ink, said ink being substantially insoluble in said coating.

16. A printing method comprising the steps of:

a. providing a substrate;

b. placing a water based ink layer over at least a portion of said substrate; and c. fixing said ink layer over said at least a portion of said substrate;

said fixing comprising the steps of:

placing an organic based coating in a fluid form over said ink layer while said ink layer is wet, said coating of a material for bonding with said ink layer and being such that said ink layer is visible therethrough; and treating said coating to enhance said bonding of said ink layer onto said substrate.

17. The method of claim 16, wherein said treating step includes curing said coating.

18. The method of claim 16, wherein said ink layer is of a material substantially insoluble in said coating.

19. The method of claim 16, wherein said at least a portion of the image includes the entire image.

* * * * *